US005601356A

United States Patent [19]

McWilliams

[11] Patent Number: 5,601,356

[45] Date of Patent: Feb. 11, 1997

[54] FLASHLIGHT STAND AND WRIST MOUNT SYSTEM

[76] Inventor: Dean K. McWilliams, 430 Westwood Dr., Ft. Collins, Colo. 80524

[21] Appl. No.: 491,214

[22] Filed: Jun. 16, 1995

[51] Int. Cl.[6] ..... A45F 5/00; F21L 15/08

[52] U.S. Cl. ..... 362/103; 362/191; 362/396; 224/221; 224/267; 224/901.4

[58] Field of Search ..... 362/103, 427, 362/396, 190, 191; 224/219, 221, 222, 250, 267, 901.4, 901.6; 248/229.17, 230.9, 316.1, 316.2

[56] References Cited

U.S. PATENT DOCUMENTS

| | | | |
|---|---|---|---|
| 1,200,403 | 10/1916 | Weyer | 362/103 |
| 1,268,622 | 6/1918 | Reynolds | 362/103 |
| 1,318,850 | 10/1919 | De Yong | 362/396 |
| 1,320,934 | 11/1919 | Schopp | 362/103 |
| 1,769,241 | 7/1930 | Stephani | 362/103 |
| 1,923,962 | 8/1933 | Worley | 362/103 |
| 2,024,281 | 12/1935 | Gaskin | 362/103 |
| 3,112,889 | 12/1963 | Marmo et al. | 362/103 |
| 3,273,766 | 9/1966 | Cosentino | 362/396 |
| 3,550,824 | 12/1970 | Bohanski . | |
| 4,788,631 | 11/1988 | Fuller | 362/103 |
| 5,154,506 | 10/1992 | Leard | 362/103 |

*Primary Examiner*—Ira S. Lazarus
*Assistant Examiner*—Sara Sachie Raab
*Attorney, Agent, or Firm*—Dean P. Edmundson

[57] ABSTRACT

A flashlight stand and wrist mount comprising a molded high-impact resistant plastic base shaped to facilitate the hands-free positioning of a flashlight in any desired direction. The device additionally comprises straps which can encircle the forearm of a person or similarly sized object allowing an attached flashlight to be carried or mounted on the arm or other object. A flashlight can be attached to the base utilizing one or more rings attached to a pivot point on the base, allowing for directional adjustment of the flashlight.

5 Claims, 4 Drawing Sheets

FLASHLIGHT STAND AND WRIST MOUNT SYSTEM

FIELD OF THE INVENTION

This invention relates generally to flashlight holding or supporting devices. More particularly, this invention relates to devices for attaching or supporting a flashlight on a person's forearm or wrist.

BACKGROUND OF THE INVENTION

The invention is in the field of flashlight holding devices, particularly those which can be utilized in both stationary and mobile applications. In virtually all cases where an individual needs to work or play in a dark environment they identify a need or desire to direct light on an object or area without the use of their hands. A number of devices have been previously proposed to address this issue which involve some type of mechanical holder which engages a flashlight. See for example, the following U.S. patents:

- U.S. Pat. No. 1,200,403 HOLDER FOR ELECTRIC FLASHLIGHTS
- U.S. Pat. No. 1,268,622 SEARCH LIGHT HOLDER
- U.S. Pat. No. 1,318,850 ELECTRIC FLASHLIGHT HOLDER
- U.S. Pat. No. 1,320,934 FLASHLIGHT ATTACHMENT
- U.S. Pat. No. 1,769,241 WRIST ATTACHMENT FOR FLASHLIGHTS
- U.S. Pat. No. 1,923,962 FLASHLIGHT
- U.S. Pat. No. 2,024,281 LIGHT
- U.S. Pat. No. 3,112,889 WRIST SUPPORTED FLASHLIGHT
- U.S. Pat. No. 3,550,824 ADJUSTABLE SUPPORT FOR WRIST
- U.S. Pat. No. 4,788,631 WRIST MOUNTED FLASHLIGHT
- U.S. Pat. No. 5,154,506 FLASHLIGHT ARMBAND

The devices described in all of the foregoing patents are characterized by some type of mounting device which attaches a flashlight to the wrist. In all cases the design is such that the device is intended to function when attached to the wrist or in one case, U.S. Pat No. 1,318,850 ELECTRIC FLASH LIGHT HOLDER, to the wearer's belt.

It is not uncommon when applying temporary light to an object for the light to be stationary and adjustable in angle and direction. The above mentioned devices do not meet this need as they have a common design for portable attachment and not for stationary use. There is a need for a modern flashlight holder which is designed and capable of adjustable direction of a flashlight from a stationary position in addition to being readily attachable to the wrist for directional portable lighting.

SUMMARY OF THE INVENTION

This invention fulfills the above stated need by providing a system comprising a molded high-impact resistant plastic body which can be placed on any desired surface. For example, placing the body with its base on a horizontal surface allows for the light from a light source to be directed horizontally or at an angle relative to a horizontal plane. The placement of the body on one end allows the flashlight to be directed vertically.

The body can be readily attached to either wrist or forearm and utilized for hands-free portable lighting capable of a wide range of directional adjustment. The adjustable ring which attaches a flashlight to the body of the device may be adjusted in diameter to allow for the use of all modern flashlights with the device.

Other advantages of the system of the present invention will be apparent from the following detailed description. The invention is described in more detail hereinafter with reference to the accompanying drawings.

DETAILED DESCRIPTION OF INVENTION

In its preferred form the support system (10) of the invention comprises three basic components: 1) The molded high impact resistant plastic base member (12) which serves both as a platform for stationary holding of a light source and as a shaped wrist or forearm mount for portable use of a light source; 2) An adjustable diameter ring(14) which attaches the light source to the high-impact resistant plastic carrier(15) that is attached to the base(12) with an adjustable pivot mounting; 3) The attachment straps(18) which preferably utilize hook and loop fastener material, at the front and rear of the base to encircle the wrist, forearm or other similar shaped object.

Figure 1:
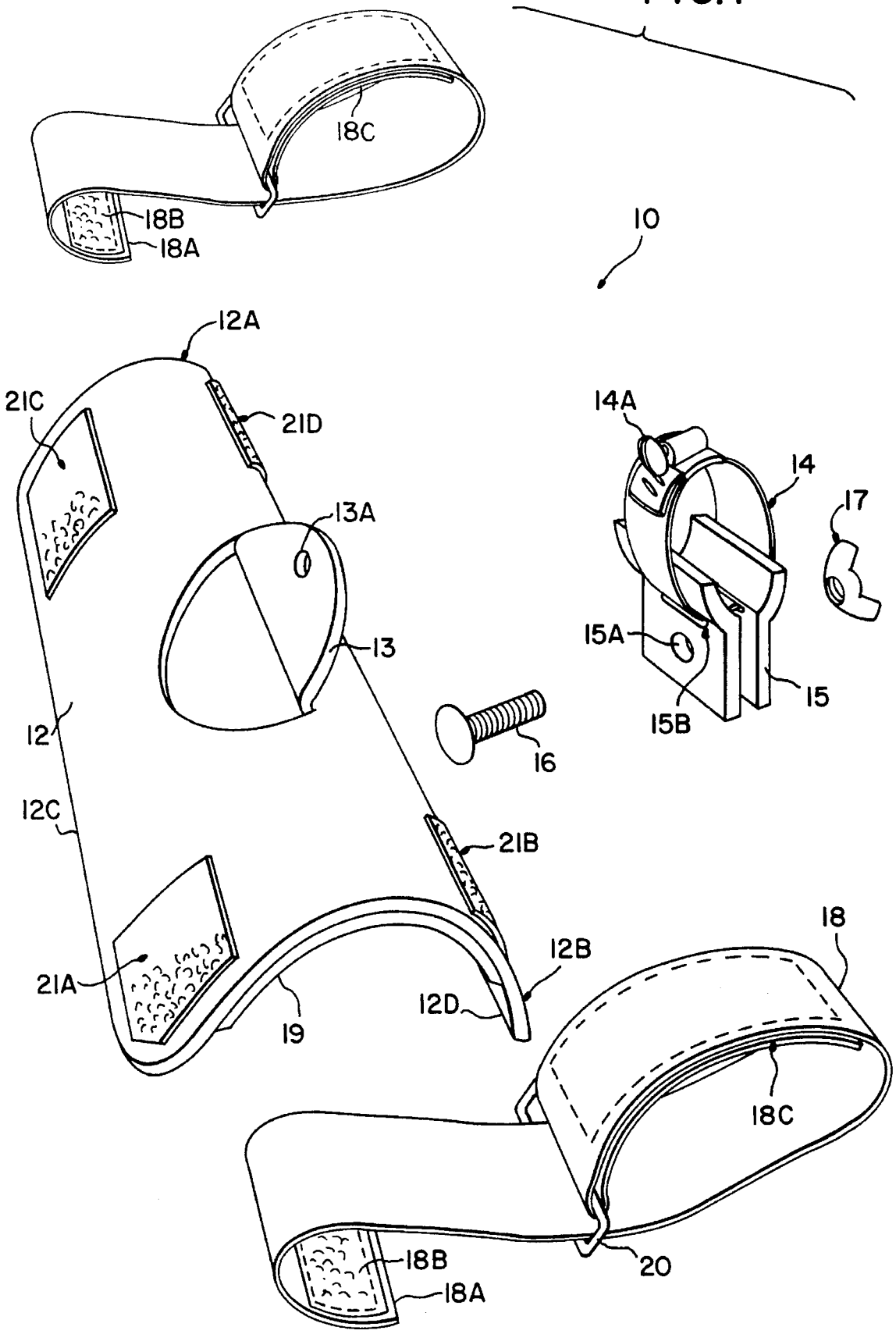
FIG. 1 is an exploded view of one embodiment of light support system of the invention.
Figure 2:
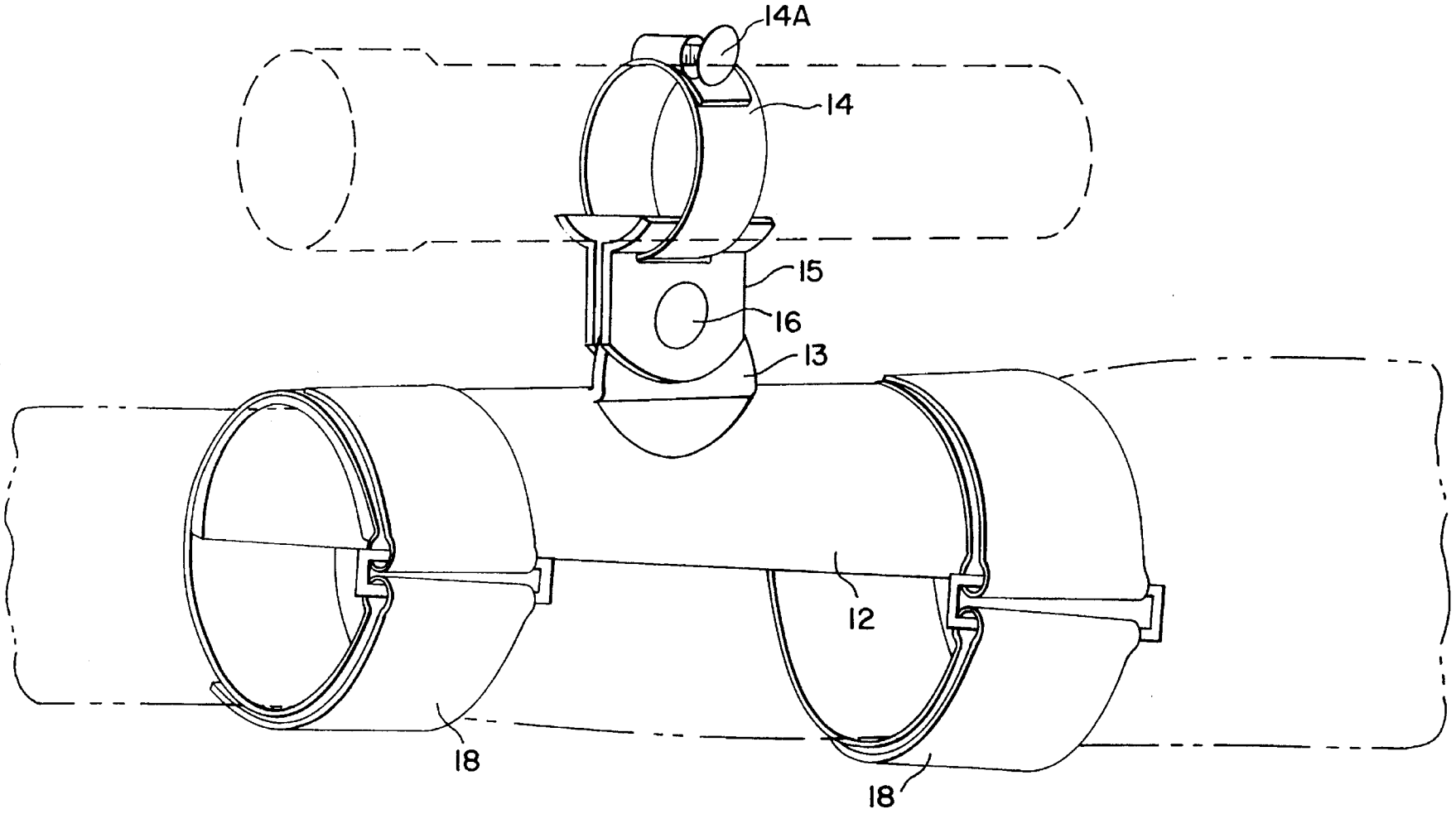
FIG. 2 is a perspective view illustrating use of the light support system of FIG. 1 to support or attach a flashlight to the forearm of a person.
Figure 3:
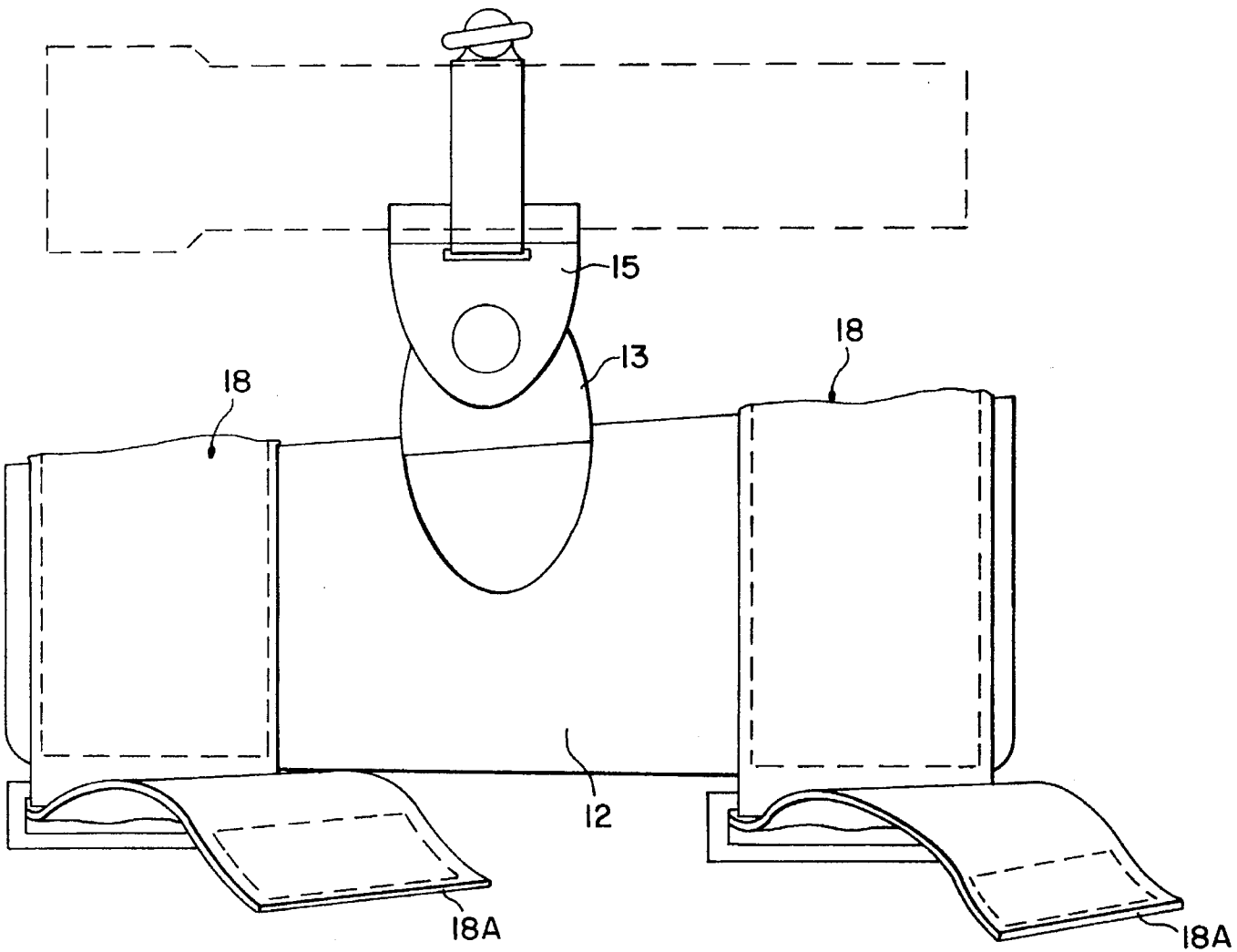
FIG. 3 is a perspective view of the light support system of FIG. 1 when used in one desired manner to support a flashlight on a stationary surface.

The base(12) is preferably molded in a U shape (cross-section) with the radius of curvature being preferably smaller at the front end(12A) and tapering to a larger radius at the rear end(12B), consistent with the taper of a person's forearm. The lower edges(12C and 12D) of the base provide the platform on which the base sits when the device is used for stationary horizontal lighting applications. The rear end(12B) of the base (larger radius of the U shape) is preferably perpendicular to the long axis of the base and the long axis of the flashlight, thereby forming the platform for the placement of the unit on a surface for stationary vertical lighting. In the center of the top of the base member, a semi-circular tab(13) projects upwardly, perpendicular to the base member thereby forming a mounting point for the flashlight "ring" carrier(15). As illustrated in FIG. 1, the tab(13) may be formed by cutting a semi-circular arc through the base material and then folding or bending the tab upwardly. Alternatively, the tab may be formed of separate material which is fastened to the base member (e.g. by means of adhesive, snaps, screws, etc.).

The tab(13) preferably includes an opening(13A) through which bolt(16) may extend as well as through corresponding opening (15A) in the lower end of carrier(15) for pivotal mounting of the carrier to the tab. By tightening nut(17) on bolt(16) the orientation of carrier(15) on tab(13) can be maintained in a desired fixed position. Loosening nut(17) enables the carrier to be tilted to any desired angle relative to the tab(13).

The carrier(15) is preferably molded from plastic material identical to the base and is the means of flashlight ring attachment and angular adjustment of the light. The adjustable ring(14) defines a round opening for slidably receiving the barrel of a flashlight. The carrier(15) preferably comprises two matching platforms containing slotted openings(15B) to hold the ring(14). The carrier may include two tabs or legs extending downward as shown. These tabs have openings(15A) allowing attachment thereof to tab(13) on the base with bolt(16) providing an attachment and pivot point between the base and the carrier. This arrangement allows tool-free adjustment of the angle of light relative to the long axis of the base member(12).

The ring(14) in preferred form comprises an adjustable metal band which attaches to carrier(15) through slotted openings(15A) in the carrier. The ring(14) diameter is adjusted by tightening a thumb-turn bolt(14A) to obtain desired tension around a flashlight barrel. This type of ring may be, for example, a hose clamp.

On the interior surface of the body(12) at the front and rear are preferably located foam rubber padding strips(19) to provide user comfort when the unit is attached to the wrist or forearm.

The flexible attachment straps(18), which preferably include hook and loop materials encircle the "U" shaped base at the front and the rear ends. In detail the straps at the front and rear of the unit are identical in design and function with the only difference being that the rear strap is slightly longer to accommodate the larger circumference at the rear of the base. Each strap has a slotted ring(20) stitched thereto to define one end of the strap. The opposite end of the strap passes through the slotted ring, and folds back on itself. End(18A) includes a strip of fastening material(18B) which secures to the mating fastening material which the strap is constructed. Preferred mating fastening materials are hook and loop fastener material.

Preferably each strap includes a strip(18C) of fastener material on the inside radius of the strap for fastening to strips(21A and 21B at the rear end, 21C and 21D at the front end) of mating fastener material which are secured (e.g. by means of adhesive) to the outer surface of body member(12) (one patch on each side near the front and one patch on each side near the rear end of the body member). This arrangement assures that each of the straps(18) will not slide off the body member during use. The straps are preferably non-elastic.

Figure 4:
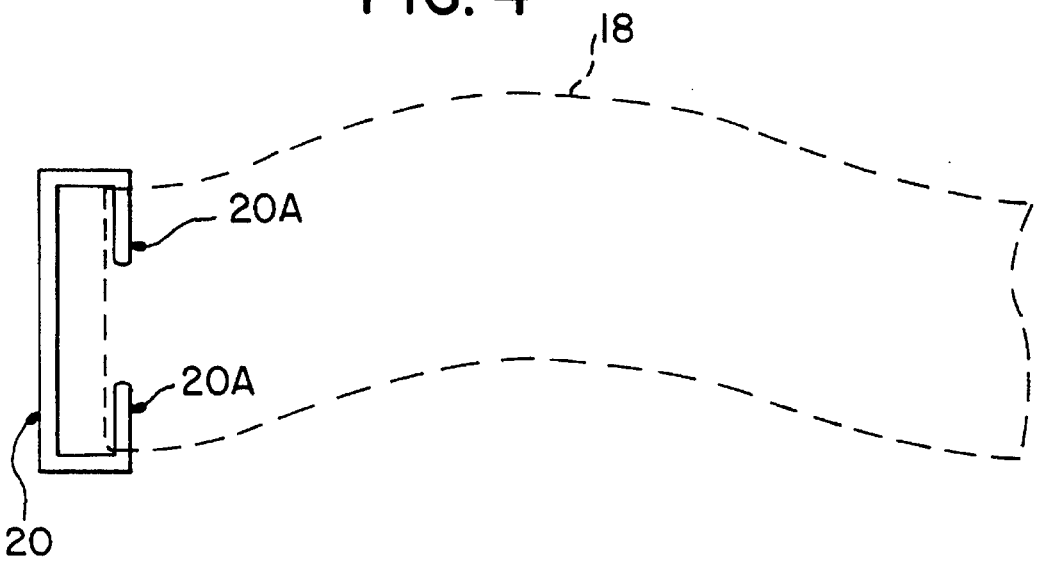
FIG. 4 illustrates one style of loop or ring which may be used in the light support system of the invention which enables the system to "breakaway" from the user's arm when a predetermined force is exerted on the system.
Figure 5:
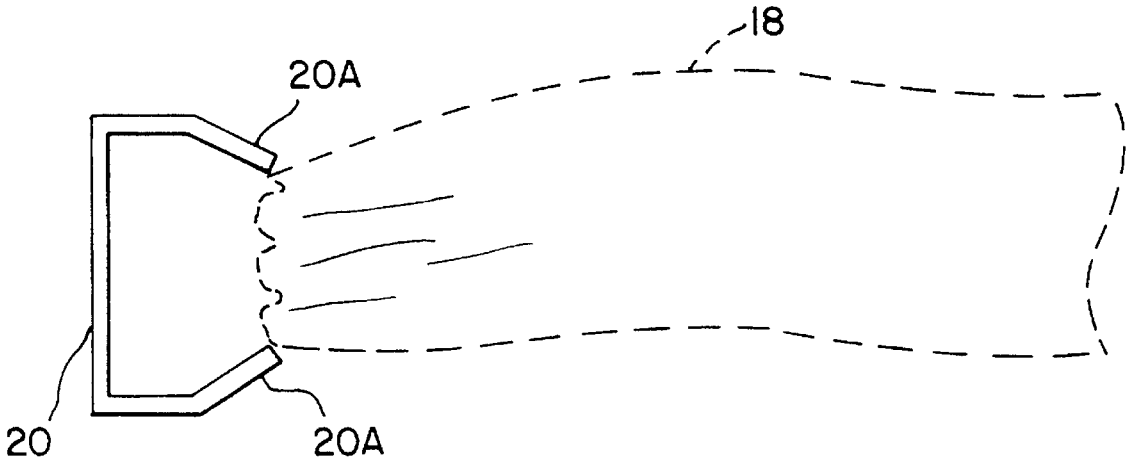
FIG. 5 illustrates the loop or ring in the "breakaway" position after a predetermined force is exerted on it.

The slotted ring(20) is preferably designed to break away for emergency release of the base from the arm of the user. The break away occurs by the straightening or deflection of the ends(20A) of the slotted rings when excessive forces exist on strap(18), as depicted in FIG. 4 and FIG. 5. Because the end portions(20A) of ring(20) are deflectable and resilient, they will deflect outwardly when a large force is applied to the strap.

The length of the base or body member(12) may vary, e.g. from about three inches to about six inches. The preferred material for the body member(12) is impact-resistant plastic which is tough, durable and light in weight. If desired, the base member could be made from metal (e.g. aluminum), fiberglass or composite materials. The thickness of the material may also vary, depending upon the strength required and also depending upon any weight limitations which might exist.

What is claimed is:

1. A flashlight holder system comprising:

(a) an elongated base member having a curved cross-sectional shape;

(b) attachment means for attaching a flashlight to said base member; wherein said attachment means comprises a ring having an adjustable diameter; wherein said ring is pivotally attached to said base member by means of a bolt;

(c) adjustable straps carried by the base member for attaching said base member to a user's arm, wherein said straps include hook and loop fasteners;

(d) lock means for locking said attachment means in a fixed position relative to said base member.

2. A system in accordance with claim 1, wherein each said strap includes a slotted ring member through which said strap is looped.

3. A system in accordance with claim 2, wherein said slotted ring comprises separate leg portions, wherein said leg portions are resilient and deflectable from a normally closed position to an open position to enable said strap to detach from said ring when a predetermined force is applied against said strap.

4. A system in accordance with claim 1, wherein said straps are attached to said base member by means of hook and loop fasteners.

5. A flashlight holder system comprising:

(a) an elongated base member having a curved cross-sectional shape;

(b) attachment means for attaching a flashlight to said base member; wherein said attachment means is carried by said base member;

(c) adjustable straps carried by the base member for attaching said base member to a user's arm; wherein said straps include hook and loop fasteners; and wherein said straps are attached to said base member by means of hook and loop fasteners.

* * * * *